United States Patent [19]

Muenter et al.

[11] Patent Number: 5,013,642

[45] Date of Patent: May 7, 1991

[54] PHOTOGRAPHIC ELEMENT

[75] Inventors: Annabel Muenter; Anthony Adin, both of Rochester; Richard L. Parton, Webster, all of N.Y.; Nicholas A. Pightling, Ruislip Manor; David Beaumond, Chalfont St. Giles, both of United Kingdom

[73] Assignee: Eastman Kodak Company, Rochester, N.Y.

[21] Appl. No.: 437,004

[22] Filed: Nov. 15, 1989

[51] Int. Cl.[5] ..... G03C 1/02

[52] U.S. Cl. ..... 430/574; 430/576; 430/584; 430/944

[58] Field of Search ..... 430/574, 576, 584, 944

[56] References Cited

U.S. PATENT DOCUMENTS

| | | | |
|---|---|---|---|
| 3,582,344 | 6/1971 | Heseltine et al. | 430/584 |
| 4,619,892 | 10/1986 | Simpson et al. | 430/505 |
| 4,801,525 | 1/1989 | Mihara et al. | 430/944 |

FOREIGN PATENT DOCUMENTS

| | | | |
|---|---|---|---|
| 63-115160 | 5/1988 | Japan | 430/584 |

OTHER PUBLICATIONS

Chemical Abstracts, vol. 101:181246g "Photothermographic Material", JP 58,145,936, Aug. 31, 1983, Asahi Chemical Industry Co. Ltd.

*Primary Examiner*—Charles L. Bowers, Jr.
*Assistant Examiner*—Thomas R. Neville
*Attorney, Agent, or Firm*—Andrew J. Anderson

[57] ABSTRACT

A photographic element is disclosed comprising a support having thereon a silver halide emulsion layer spectrally sensitized with (a) a first sensitizing dye according to the formula:

$Z_1$ and $Z_2$ each independently represents the atoms necessary to complete a substituted or unsubstituted 5- or 6-membered heterocyclic nucleus, $R_1$ and $R_2$ each independently represents substituted or unsubstituted alkyl or substituted or unsubstituted aryl.

$R_3$, $R_4$, $R_5$, and $R_6$ each independently represents hydrogen, substituted or unsubstituted alkyl, substituted or unsubstituted aryl, and X represents a counterion, and (b) a second sensitizing dye having a maximum sensitivity at a wavelength of about 5 to 100 nm less than the wavelength of maximum sensitivity of the first sensitizing dye.

10 Claims, No Drawings

PHOTOGRAPHIC ELEMENT

FIELD OF THE INVENTION

This invention relates to photography, and specifically to photographic elements having broad sensitivity in the infrared portion of the spectrum.

BACKGROUND OF THE INVENTION

Silver halide photography involves the exposure of silver halide with light in order to form a latent image that is developed during photographic processing to form a visible image. Silver halide is intrinsically sensitive only to light in the blue region of the spectrum. Thus, when silver halide is to be exposed to other wavelengths of radiation, such as green or red light in a multicolor element or infrared radiation in an infrared-sensitive element, a spectral sensitizing dye is required. Sensitizing dyes are chromophoric compounds (usually cyanine dye compounds) that are adsorbed to the silver halide. They absorb light or radiation of a particular wavelength and transfer the energy to the silver halide to form the latent image, thus effectively rendering the silver halide sensitive to radiation of a wavelength other than in the blue region of intrinsic sensitivity.

The advent of solid state diodes that emit red and infrared radiation has expanded the useful applications of infrared-sensitive photographic elements. The diodes have a wide variety of emission wavelengths, ranging from around 660 nm to around 910 nm. Typical emission wavelengths include 750 nm, 780 nm, 810 nm, 820 nm, and 870 nm. Because of the wide variety of emission wavelengths, it would be desirable for an infrared-sensitive photographic material to have broad sensitivity in the infrared region of the spectrum. This would allow a single material to be used with a diodes having a variety of emission wavelengths.

Such broad sensitivity can generally be provided by either using a single sensitizing dye that provides broad sensitivity or by a combination of sensitizing dyes (usually two) that, by themselves, would provide narrower sensitivity. Many such broad sensitizing dyes can suffer from a number of problems, such as poor keeping stability (e.g., formation of fog during keeping) and poor safelight performance. Many dye combinations also have disadvantages, such as poor sensitivity (e.g., due to desensitization) or poor keeping stability (e.g., formation of fog during keeping).

It is an object of this invention to provide silver halide with broad sensitivity in the infrared region of the spectrum without incurring the above-described problems.

SUMMARY OF THE INVENTION

According to the invention, there is provided a photographic element comprising a support having thereon a silver halide emulsion layer spectrally sensitized with (a) a first sensitizing dye according to the formula:

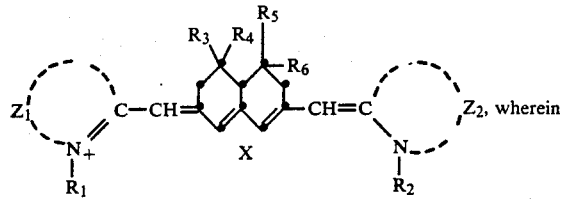

(I)

$Z_1$ and $Z_2$ each independently represents the atoms necessary to complete a substituted or unsubstituted 5- or 6- membered heterocyclic nucleus, $R_1$ and $R_2$ each independently represents substituted or unsubstituted alkyl or substituted or unsubstituted aryl, $R_3$, $R_4$, $R_5$, and $R_6$ each independently represents hydrogen, substituted or unsubstituted alkyl, substituted or unsubstituted aryl, and X represents a counterion as needed to balance the charge of the molecule, and (b) a second sensitizing dye having a maximum sensitivity at a wavelength of about 5 to 100 nm less than the wavelength of maximum sensitivity of the first sensitizing dye.

The above-described dye combination provides broad sensitivity in the infrared region of the spectrum with good photographic speed, has good keeping stability, and can be handled under safelight conditions without excessive unwanted exposure.

DESCRIPTION OF THE PREFERRED EMBODIMENTS

According to formula (I), $Z_1$ and $Z_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, or thiazoline nucleus. This nucleus may be substituted with known substituents, such as halogen (e.g., chloro, fluoro, bromo), alkoxy (e.g., methoxy, ethoxy), alkyl, aryl, aralkyl, sulfonate, and others known in the art. Dyes where $Z_1$ and $Z_2$ are each independently substituted or unsubstituted: thiazole, selenazole, quinoline, tellurazole, or pyridine nuclei will tend to have maximum sensitivities of greater than about 790 nm. Dyes where at least one of $Z_1$ and $Z_2$ is an substituted or unsubstituted oxazole or thiazoline nucleus will tend to have maximum sensitivities of less than about 800 nm. Especially preferred are dyes where $Z_1$ and $Z_2$ are substituted or unsubstituted thiazole nuclei.

Examples of useful preferred nuclei for $Z_1$ and $Z_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methyl benzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, naphtho[2,1-d]thiazole, naptho[1,2-d]thiazole, 5-methoxynaphtho[2,3-d]thiazole, 5-ethoxynaphtho[2,3-d]thiazole, 8-methoxynaphtho[2,3-d]thiazole, 7-methoxy-naphtho[2,3-d]thiazole, 4'-methoxythianaphtheno-7',6' - 4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole 5-ethoxybenzoxazole, 5-chlorobenzoxazole, 6-methoxybenzoxazole, 5-hydroxybenzoxazole, 6-hydroxybenzoxazole,naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g, 2-pyridine, 5-methyl-2-pyridine, 4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1,2-d]tellurazole, 5,6-dimethoxytellurazole, 5-methoxytellurazole, 5-methyltellurazole; a thiazoline nucleus. e.g., thiazoline. 4-methylthiazoline, etc.

$R_1$ and $R_2$ may be substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., β-hydroxyethyl, ω-hydroxybutyl, etc., an alkoxyalkyl group, e.g., β-methoxyethyl, ω-butoxybutyl, etc., a carboxyalkyl group, e.g., β-carboxyethyl, ω-carboxybutyl, etc.; a sulfoalkyl group, e.g., β-sulfoethyl, ω-sulfobutyl, etc., a sulfatoalkyl group, e.g., β-sulfatoethyl, ω-sulfatobutyl, etc., an acyloxyalkyl group, e.g., β-acetoxyethyl, γ-acetoxypropyl, ω-butyryloxbutyl, etc., an alkoxycarbonylalkyl group, e.g., β-methoxycarbonylethyl, ω-ethoxycarbonylbutyl, etc., or an aralkyl group, e.g., benzyl, phenethyl, etc., or, any aryl group, e.g., phenyl, tolyl, naphthyl, methoxyphenyl, chlorophenyl, etc. Alkyl and aryl groups may be substituted by one or more of the substituents exemplified above.

$R_3$, $R_4$, $R_5$, and $R_6$ each independently represents hydrogen, substituted or unsubstituted alkyl, substituted or unsubstituted aryl, and are preferably hydrogen or methyl. Examples of aryl groups useful as $R_3$ and $R_4$ include phenyl, tolyl, methoxyphenyl, chlorophenyl, and the like. Examples of unsubstituted alkyl groups useful as $R_3$–$R_6$ include the unsubstituted alkyls described above for $R_1$ and $R_2$. Examples of substituents for alkyl groups are known in the art, e.g., alkoxy and halogen.

X represents a counterion as necessary to balance the charge of the dye molecule. The counterion may be ionically complexed to the molecule or it may be part of the dye molecule itself to form an intramolecular salt. Such counterions are well-known in the art. For example, when X is an anion (e.g., when $R_1$ and $R_2$ are unsubstituted alkyl), examples of X include chloride, bromide, iodide, p-toluene sulfonate, methane sulfonate, methyl sulfate, ethyl sulfate, perchlorate, and the like. When X is a cation (e.g., when $R_1$ and $R_2$ are both sulfoalkyl or carboxyalkyl), examples of X include sodium, potassium, triethylammonium, and the like.

Examples of dyes according to formula (I) are set forth below.

TABLE I

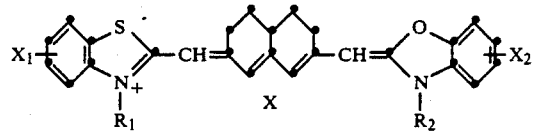

| Dye | $X_1$ | $X_2$ | $R_1$ | $R_2$ | X |
|---|---|---|---|---|---|
| I-1 | H | H | Et | Me | $ClO_4^-$ |
| I-2 | H | 4,5-Benzo | Et | Et | $ClO_4^-$ |
| I-3 | H | 4,5-Benzo | Et | $Sp^-$ | — |
| I-4 | H | 5,6-Me | Et | Et | $I^-$ |
| I-5 | 6-Me | 5,6-Me | Et | Et | $I^-$ |
| I-6 | 5-OMe | 5,6-Me | Et | Et | $BF_4^-$ |
| I-7 | 4,5-Benzo | 5,6-Me | Et | Et | $I^-$ |

TABLE II

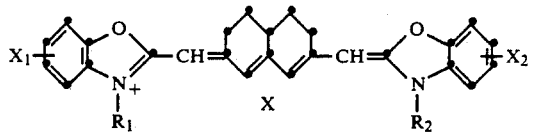

| Dye | $X_1$ | $X_2$ | $R_1$ | $R_2$ | X |
|---|---|---|---|---|---|
| I-8 | H | H | Et | Et | $I^-$ |
| I-9 | 5,6-Benzo | 5,6-Benzo | Et | Et | $CF_3SO_3^-$ |

TABLE III

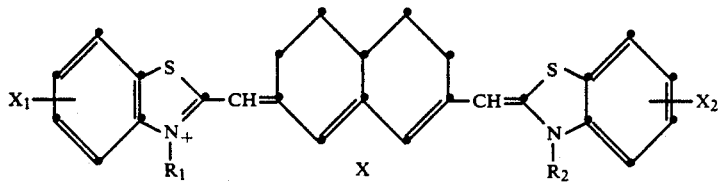

| Dye | $X_1$ | $X_2$ | $R_1$ | $R_2$ | X |
|---|---|---|---|---|---|
| I-10 | —H | —H | Et | Et | $PTS^-$ |
| I-11 | 5-SMe | 5-SMe | Me | Me | $CF_3SO_3^-$ |
| I-12 | 5-OMe | 5-OMe | Et | Et | $PTS^-$ |
| I-13 | 5,6-SMe | 5,6-SMe | Et | Et | $PTS^-$ |
| I-14 | 4,5-Benzo | 4,5-Benzo | Et | Et | $PTS^-$ |

TABLE III-continued
I-15
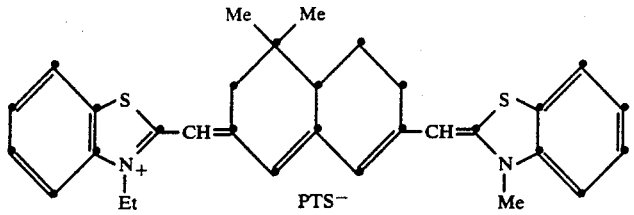
I-16
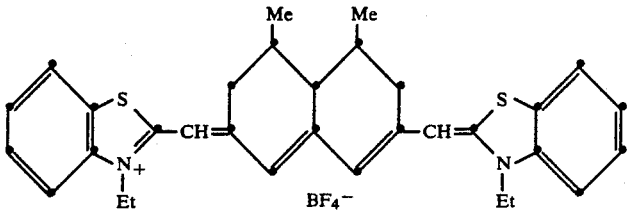
I-17
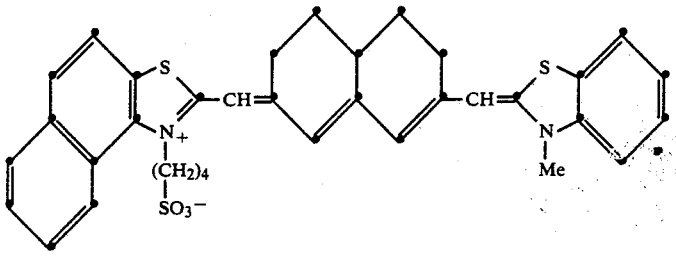
I-18
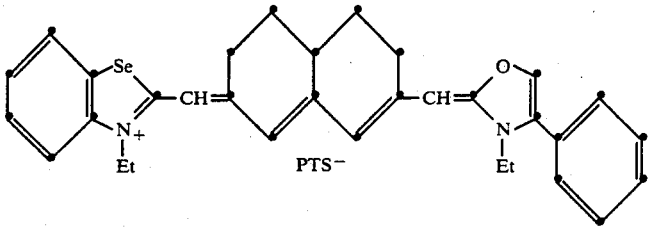
I-19
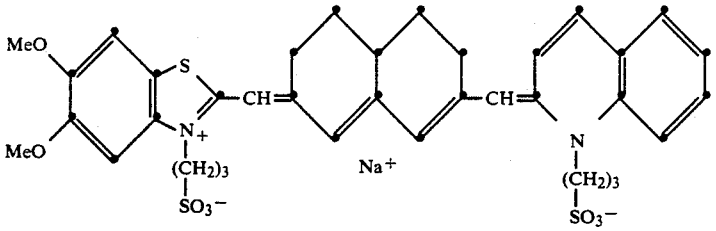
I-20
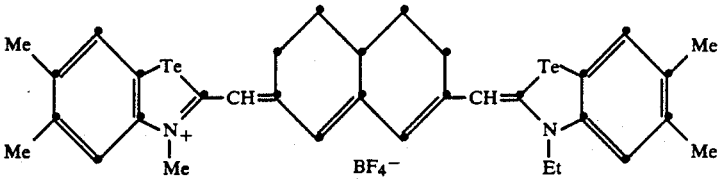
I-21
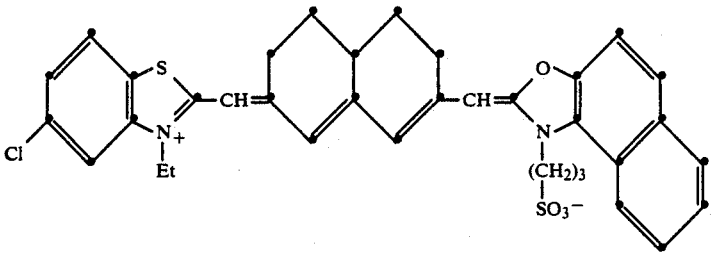

TABLE III-continued

I-22

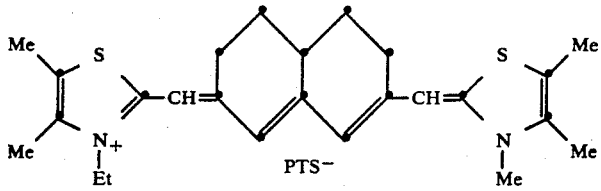

PTS = p-toluene sulfonate
Sp = 3-sulfopropyl
Me = methyl
Et = ethyl
SMe = thiomethyl Tricarbocyanine dyes and their methods of synthesis are well-known in the art. Synthetic techniques for known tricarbocyanine dyes, such as set forth by Hamer, Cyanine Dyes and Related Compounds, John Wiley & Sons, 1964, apply equally as well to the dyes of formula (I). Synthesis of the dyes of formula (I) is also described in U.S. Pat. No. 3,582,344 and A. I. Tolmachev et al, Dokl. Akad. Nauk SSSR, 177, 869-872 (1967), the disclosures of which are incorporated herein by reference.

According to the invention, the sensitizing dye according to formula (I) is used in combination with a second sensitizing dye having a maximum sensitivity at a wavelength of about 5 to 100 nm less than the wavelength of maximum sensitivity of the formula (I) dye. This second sensitizing dye can be essentially any known sensitizing dye. Especially preferred second sensitizing dyes are those according to the formula:

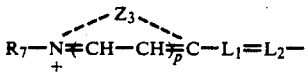

(II)

-continued

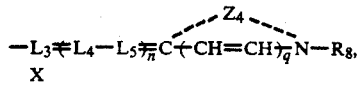

wherein $L_1$, $L_2$, $L_3$, $L_4$, and $L_5$ each independently represents a substituted or unsubstituted methine group, $Z_3$ and $Z_4$ are as defined above for $Z_1$ and Z2, $R_7$ and $R_8$ are as defined above for $R_1$ and $R_2$, X represents a counterion as described above, p and q each independently represents 0 or 1, and n represents 1 or 2, or, if at least one of p and q is 1, may also represent 0.

$L_1$-$L_5$ may be unsubstituted, i.e., —CH=, or substituted with known substituents such as alkyl, aryl, heterocyclic groups, halogen, and the like. The substituents may also be in the form of bridged rings, e.g., a 6-membered carbocyclic ring containing $L_2$, $L_3$, and the adjacent $L_4$ methine group where n=2, or a 10-membered carbocyclic ring containing $L_2$, $L_3$, and the adjacent three methine groups where n=2. Also useful as L groups are equivalents of methine groups, such as a heterocyclic nitrogen atom when the methine chain linking the cyanine-type heterocycles includes, for example a rhodanine ring.

Examples of dyes according to formula (II) include:

II-1

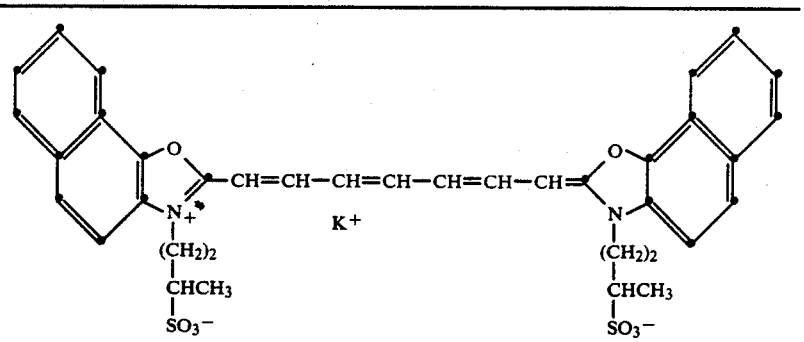

II-2

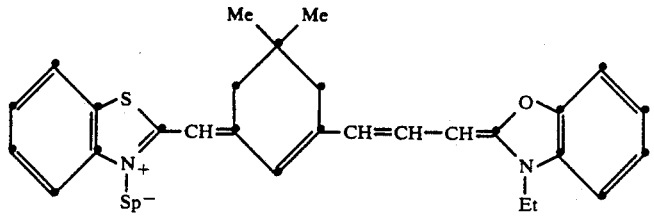

-continued
II-3 (same as I-2)
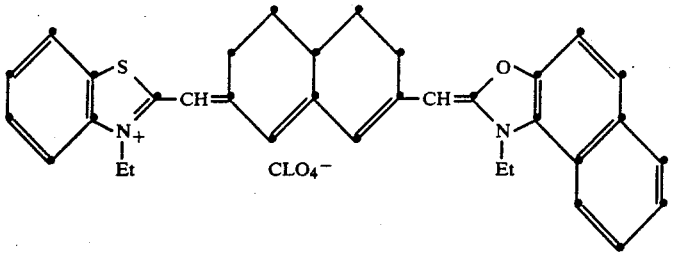
II-4
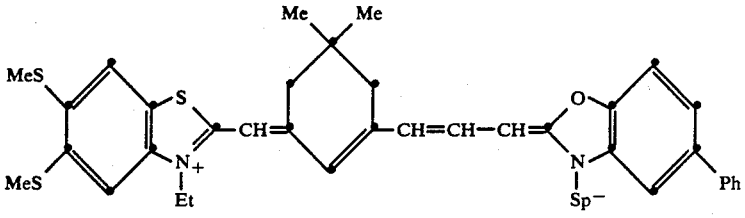
II-5
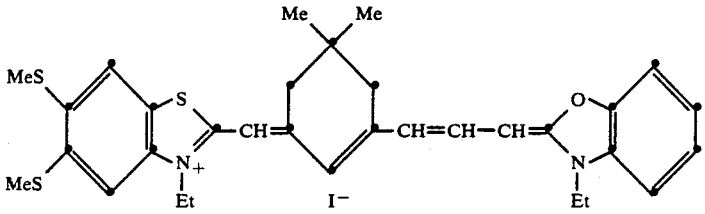
II-6
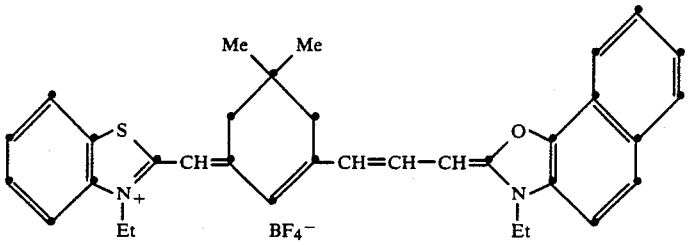
II-7
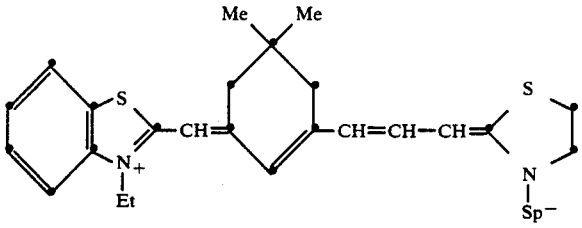
II-8
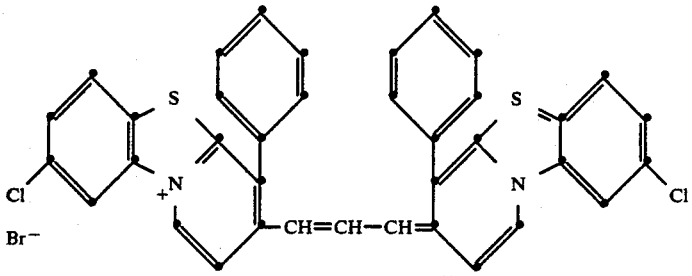
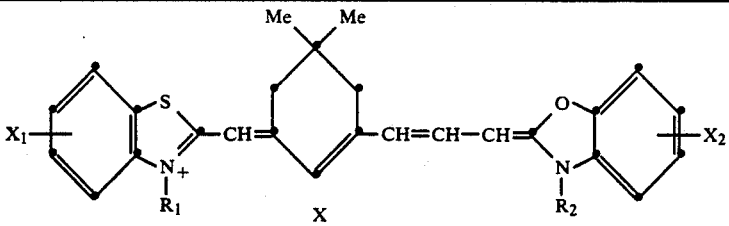

-continued

| Dye | $X_1$ | $X_2$ | $R_1$ | $R_2$ | X |
|---|---|---|---|---|---|
| II-9 | H | H | Et | Et | $BF_4^-$ |
| II-10 | 5-Me | H | Et | Et | $PTS^-$ |
| II-11 | H | H | $Sp^-$ | Et | — |
| II-12 | H | 5-Cl | $Sp^-$ | $Sp^-$ | $Na^+$ |
| II-13 | 5-Ph | 5-Cl | Et | Et | $PTS^-$ |

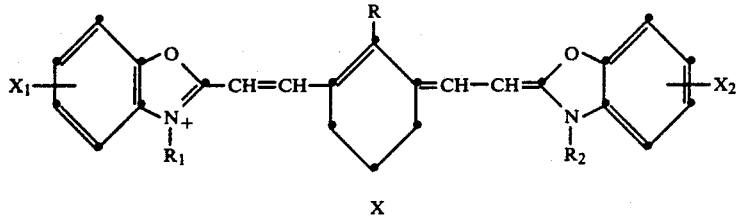

| Dye | $X_1$ | $X_2$ | R | $R_1$ | $R_2$ | X |
|---|---|---|---|---|---|---|
| II-14 | 5,6-Me | 5,6-Me | Cl | Et | Et | $BF_4^-$ |
| II-15 | 5,6-OMe | 5,6-OMe | Ph | Me | Me | $PF_6^-$ |

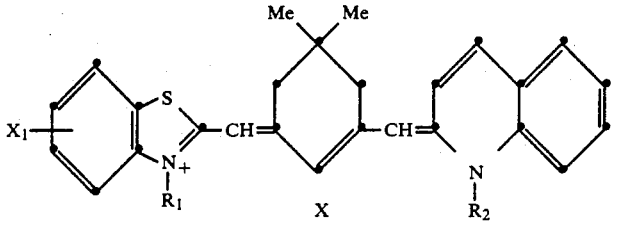

| Dye | $X_1$ | $R_1$ | $R_2$ | X |
|---|---|---|---|---|
| II-16 | 5,6-OMe | $Sp^-$ | Et | — |
| II-17 | 5,6-SMe | Et | Et | $PTS^-$ |
| II-18 | 5-Cl | $Sp^-$ | $Sp^-$ | $Na^+$ |

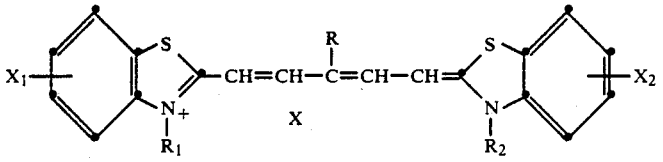

| Dye | $X_1$ | $X_2$ | R | $R_1$ | $R_2$ | X |
|---|---|---|---|---|---|---|
| II-19 | 5,6-SMe | 5,6-SMe | Me | Et | Et | $PTS^-$ |
| II-20 | 5,6-OMe | 5,6-OMe | H | $-CH_2CH_2CO_2^-$ | Et | — |
| II-21 | 4,5-Benzo | 4,5-Benzo | H | $-SBu^-$ | Me | — |

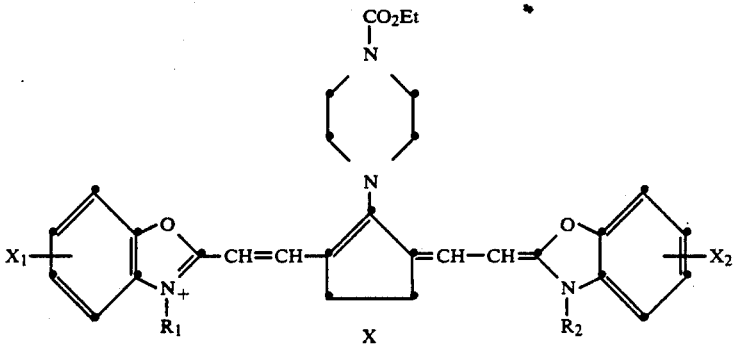

| Dye | $X_1$ | $X_2$ | $R_1$ | $R_2$ | X |
|---|---|---|---|---|---|
| II-22 | 5,6-SMe | 5,6-SMe | Et | Et | $PTS^-$ |
| II-23 | 4,5-Benzo | 4,5-Benzo | $Sp^-$ | $Sp^-$ | $Na^+$ |

-continued
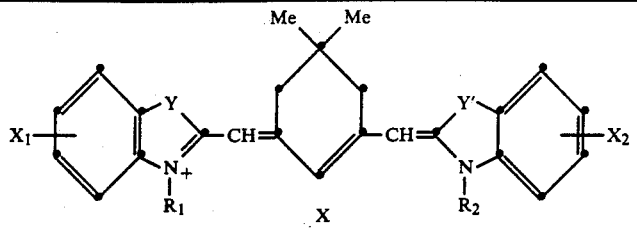
| Dye | Y | Y' | $X_1$ | $X_2$ | $R_1$ | $R_2$ | X |
|---|---|---|---|---|---|---|---|
| II-24 | Se | S | 4,5-Benzo | 4,5-Benzo | Me | Me | $BF_4^-$ |
| II-25 | Se | Se | 4,5-Benzo | 4,5-Benzo | Et | $Sp^-$ | — |
II-26
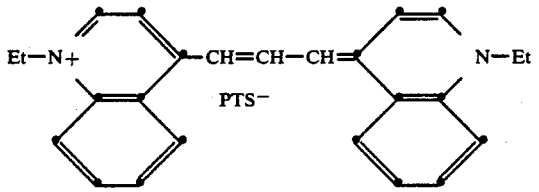
II-27
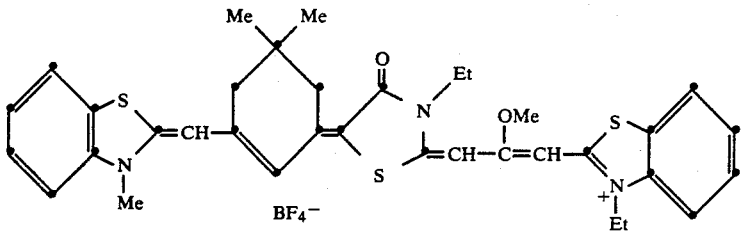
II-28
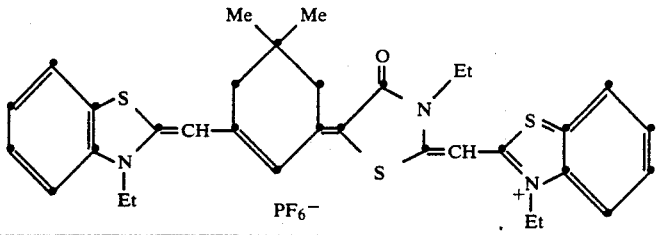
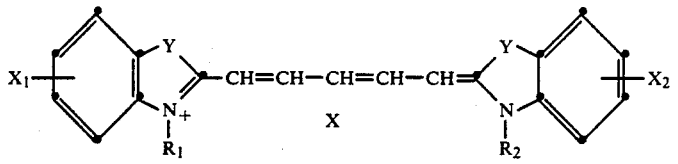
| Dye | Y | $X_1$ | $X_2$ | $R_1$ | $R_2$ | X |
|---|---|---|---|---|---|---|
| II-29 | Se | 5,6-OMe | 5,6-OMe | Et | Et | $Br^-$ |
| II-30 | Te | H | H | Me | Me | $BF_4^-$ |
II-31
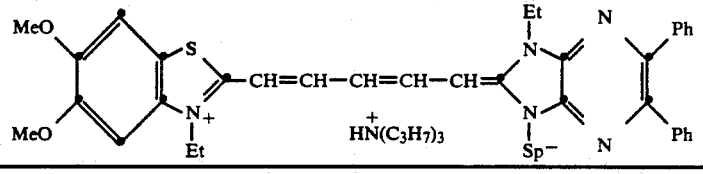
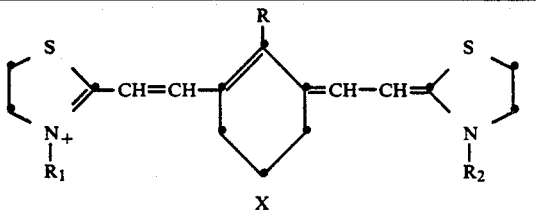
| Dye | R | $R_1$ | $R_2$ | X |
|---|---|---|---|---|
| II-32 | Ph | Me | Me | $BF_4^-$ |

-continued

| | | | | |
|---|---|---|---|---|
| II-33 | Me | $Sp^-$ | $Sp^-$ | $K^+$ |

Ph = phenyl
SBu = 4-sulfobutyl

In a preferred embodiment the second sensitizing dye according to formula (II) is of the same class as the dyes according to formula (I) (e.g., dye II-3 shown above), and is thus chosen according to formula:

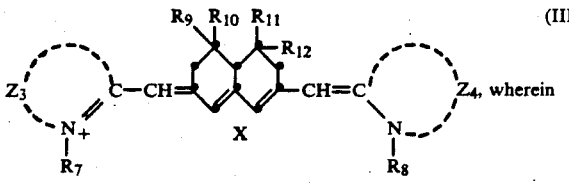

(III)

$Z_3$, $Z_4$, $R_7$, and $R_8$ are as defined above for formula (II), and $R_9$, $R_{10}$, $R_{11}$, and $R_{12}$ each independently represents hydrogen, substituted or unsubstituted alkyl, substituted or unsubstituted aryl. Examples of dyes according to formula (III) include those listed above for formula (I). Of course, when the dye combination used according to the invention is a dye of formula (I) and a dye of formula (III), the Z heterocycles and the substituents of the two dyes must be chosen so that the maximum sensitivity of the formula (I) dye is about 5 to 100 nm longer than the maximum sensitivity of the formula (III) dye.

The dyes of formulas (I), (II), and (III) are used to sensitize photographic silver halide emulsions. These silver halide emulsions can contain grains of any of the known silver halides, such as silver bromide, silver chloride, silver bromoiodide, and the like, or mixtures thereof, as described in *Research Disclosure,* Item 17643, December, 1978 [hereinafter referred to as *Research Disclosure I*], Section I. The silver halide grains may be of any known type, such as spherical, cubic, or tabular grains, as described in *Research Disclosure I,* Section I or *Research Disclosure,* Item 22534, January, 1983. The dye combinations described above can be especially useful for sensitizing high-contrast emulsions, such as those used in the graphic arts industry. Such graphic arts photographic elements are often exposed using an infrared laser diode. Thus, in a preferred embodiment, the silver halide emulsion useful in the practice of the invention has a contrast (gamma) of at least about 4, and more preferably, at least about 6.

The silver halide emulsions generally include a hydrophilic vehicle for coating the emulsion as a layer of a photographic element. Useful vehicles include both naturally-occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), and others described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount known to be useful in photographic emulsions.

In a preferred embodiment, the silver halide emulsion sensitized with above described dye combination also contains a bis-azine compound. The bis-azines useful in the invention are well-known in the art (usually as supersensitizers for red- or infrared-sensitive silver halide emulsions). They include those according to the formula:

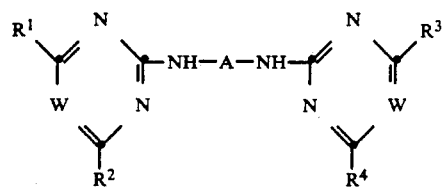

(IV)

According to formula (IV), W represents nitrogen or —$CR^5$= where $R^5$ is hydrogen, halogen (e.g., chloro, bromo, etc.), or alkyl (preferably of from 1 to 4 carbon atoms, e.g., methyl, ethyl, etc.). $R^1$, $R^2$, $R^3$, and $R^4$ each independently represents hydrogen, hydroxy, alkoxy (preferably having from 1 to 10 carbon atoms, e.g., methoxy, ethoxy, propoxy, etc.), alkyl (preferably having from 1 to 10 carbon atoms, e.g., methyl, ethyl, n-butyl, isopropyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (wherein the alkyl moiety preferably has from 1 to 10 carbon atoms, e.g., methylthio, ethylthio, etc.), a heterocyclothio group (e.g., benzothiazolylthio, etc.), an arylthio group (e g., phenylthio, tolylthio, etc.), an amino group, an alkylamino group, which term includes an unsubstituted and a substituted alkylamino group such as a hydroxy or sulfo-substituted alkylamino group (preferably an alkylamino group or substituted alkylamino group wherein the alkyl moiety has from 1 to 10 carbon atoms, e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group, which term includes an unsubstituted arylamino group and a substituted arylamino group, preferably a substituted arylamino group wherein the substituent is an alkyl group of from about 1 to 4 carbon atoms, a sulfo group, a carboxy group, a hydroxy group, and the like (e.g., anilino, o-sulfoanilino, m-sulfoanilino, p-sulfoanilino, o-anisylamino, m-anisylamino, p-anisylamino, o-toluidino, m-toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridyl-amino, etc.), an aryl group (e.g., phenyl, etc.), or a mercapto group, where $R^1$, $R^2$, $R^3$ and $R^4$ may each be the same as or different from one another.

Also according to formula (IV), A represents a divalent aromatic residue, preferably comprising 1 to 4 aromatic rings. Such residues are known in the art and are described, for example, in U.S. Pat. No. 4,199,360, the disclosure of which is incorporated herein by reference. Examples of such divalent aromatic residues include:

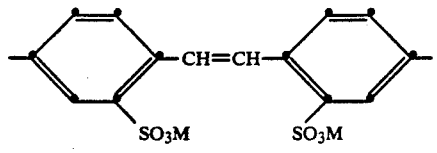

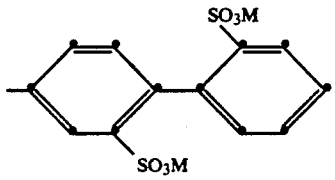

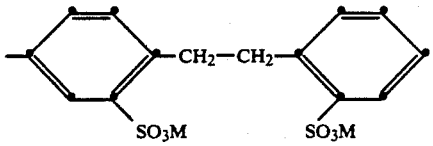

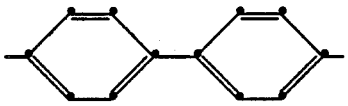

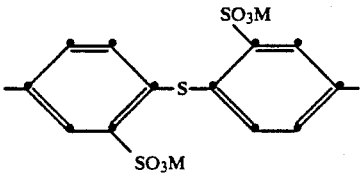

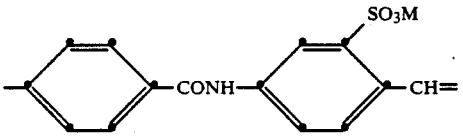

-continued

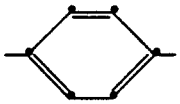

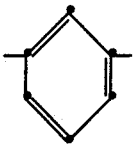

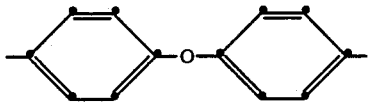

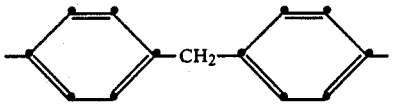

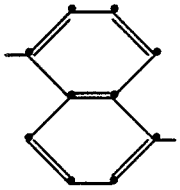

where M represents hydrogen or a cation (preferably an alkali metal, e.g., sodium, potassium, etc or an ammonium group).

In a preferred embodiment, the divalent aromatic residue represented by A is a stilbene. One such stilbene is represented by the formula:

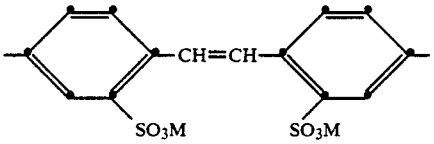

Specific examples of bis-azine compounds according to formula (IV) include:

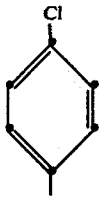

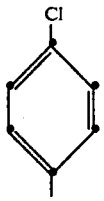

T-1

-continued
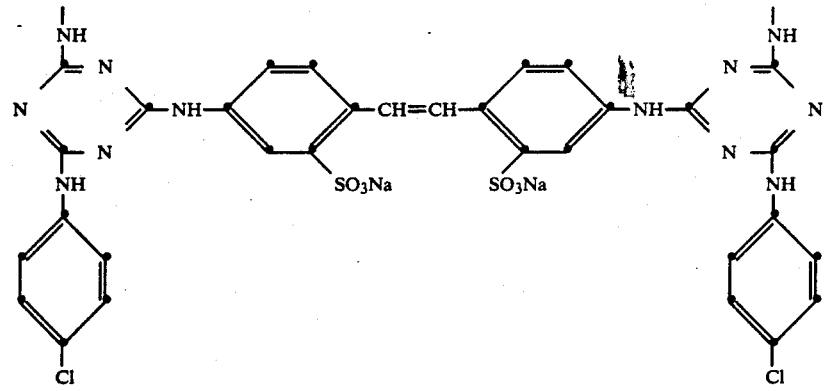
T-2
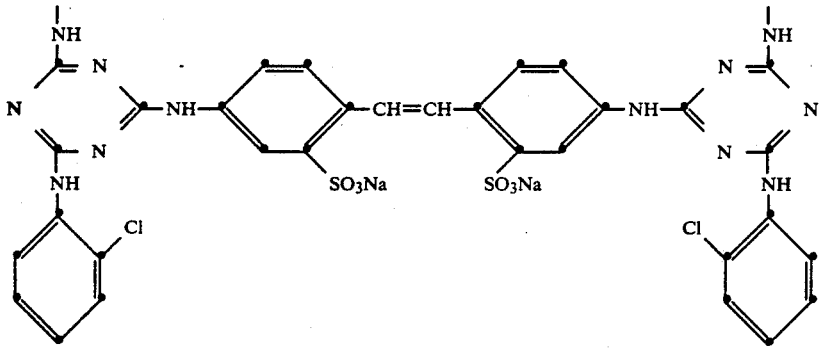
T-3
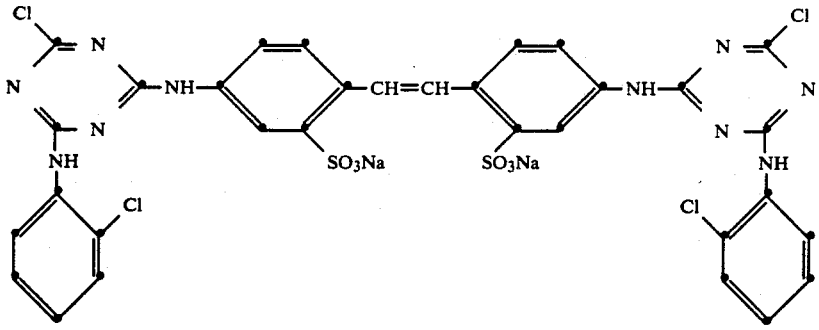
T-4
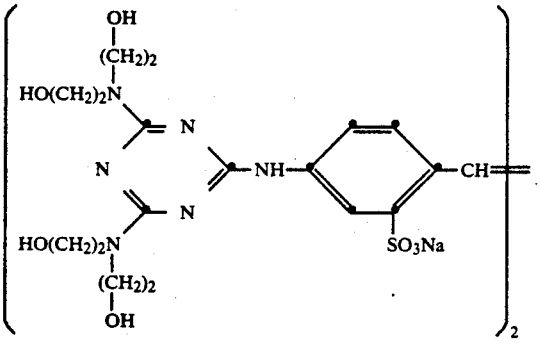

-continued

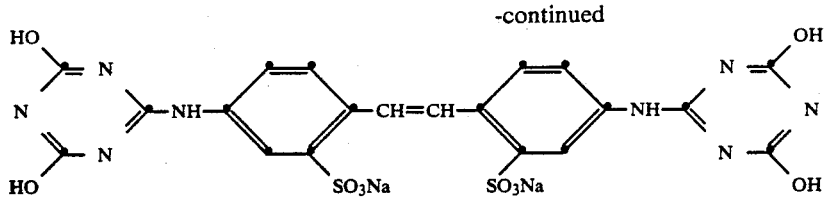

T-5

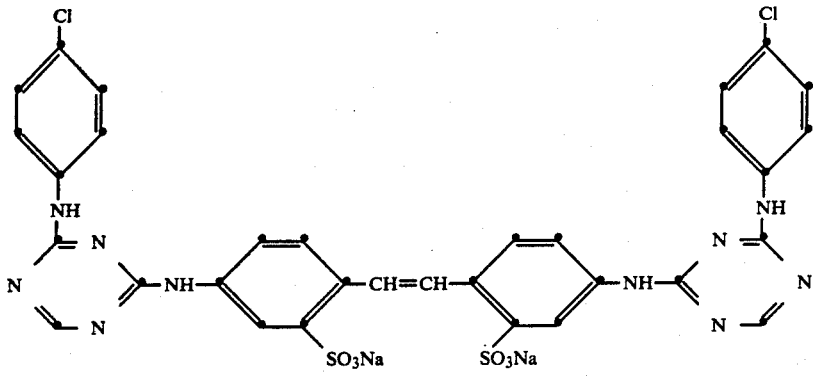

T-6

The optimum amount of the bis-azine compound will vary with factors such as the performance criteria of the photographic element, the processing conditions to be used, the type of emulsion, and the particular sensitizing dye. The bis-azine can be added to the emulsion melt or in other phases of silver halide emulsion preparation, such as during chemical sensitization. Useful amounts of the bis-azine compound preferably include from about 0.1 to about 100 moles/mole dye, although smaller amounts may also be useful depending on factors such as those identified above. Mixtures of different bis-azines can also be used.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in Research Disclosure, June, 1975, item 13452 and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein.

The emulsion layer containing silver halide sensitized with the dye of the invention can be coated simultaneously or sequentially with other emulsion layers, subbing layers, filter dye laters, or interlayers or overcoat layers, all of which may contain various addenda known to be included in photographic elements. These include antifoggants, oxidized developer scavengers, DIR couplers, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

The photographic element of the invention can be black and white or color. Since the photographic element of the invention is sensitive to infrared radiation, which is invisible to the human eye, a color element would be a false color sensitized element, with one or more infrared-sensitive layers having one or more dye-forming couplers associated therewith. Color dye-forming couplers and the various addenda associated therewith are well-known in the art and are described, for example, in *Research Disclosure I,* Section VII, and the references cited therein.

The elements of the invention can be exposed with essentially any known light source, such as an infrared- or red-emitting lamp, a light-emitting diode (LED), or a solid state laser diode. Many of the commonly-used solid state lasers emit at a wavelength of longer than about 760 nm (with 780 nm being a very common emission wavelength), and the dyes according to formula (I) can have maximum sensitivities up to about 840 nm. Thus, in one embodiment of the invention, the sensitizing dye according to formula (I) has a maximum sensitivity of between about 760 nm and 840 nm. There are also lasers and LED's that emit shorter than 760 nm, and the dyes of formula (I) can have maximum sensitivities as short as about 700 nm. Thus, in another embodiment of the invention, the sensitizing dye according to formula (I) has a maximum sensitivity of between about 700 nm and 760 nm.

The element of the invention can be processed after exposure by any of the known processing methods and chemicals, as described in Research Disclosure I.

The invention is further described in the following examples.

EXAMPLE 1

Photographic evaluation was carried out in the following photographic element, coated on transparent support. The imaging layer contained a high-contrast sulfur plus gold sensitized 0.34 μm cubic silver halide emulsion containing 68% chloride and 32% bromide and doped with rhodium. The emulsion was doctored with 500 mg/mole Ag of the supersensitizer T-2, 3.4 g/mole Ag of 2,5 diisooctyl-hydroquinone, and a substituted tetraazaindene antifoggant. Dyes were added to the emulsion at the levels indicated in Table IV. The emulsion was coated at 21.5 mg Ag/dm$^2$ with gelatin at 43.1 mg/dm$^2$. The imaging layer was overcoated with a layer containing 8.6 mg gelatin/dm$^2$ and a gelatin hardener.

To determine broadband infrared speed, the coatings were exposed to a $10^{-4}$ sec xenon flash from a sensitometer, filtered through a Kodak Wratten ® filter number 89B and a continuous density wedge with a density range of 0 to 4 density units. Processing was carried out for 6 minutes in a hydroquinone/Elon ® developer at a temperature of 20° C. Speeds were determined at 1.0 density units above fog.

To determine the spectral sensitivity distribution, the coatings were given 2 second exposures on a wedge spectrographic instrument covering a wavelength range from 400 to 850 nm. The instrument contained a tungsten light source and a step tablet ranging in density from 0 to 3 density units in 0.3 density steps. After processing in the developer for 6 minutes at 20° C., speed was read at 10 nm wavelength intervals at a density of 0.3 above fog. Correction for the instrument's variation in spectral irradiance with wavelength was done via computer and the wavelength of maximum spectral sensitivity (λ-max) was read from the resulting plot of log relative spectral sensitivity vs. wavelength. The width of the spectral sensitivity distribution was calculated by determining the two wavelengths above and below λ-max for which the spectral sensitivity decreased by 0.1 log E compared to the sensitivity at λ-max. The spectral width, which is reported in Table IV, is the difference between these two wavelengths.

TABLE IV

| Dyes (mmoles/mole Ag) | $10^{-4}$ sec. WR89B Speed/Fog | Spectral Width (nm) | λ-max (nm) |
|---|---|---|---|
| II-1 (.06) | 0.57/.04 | 33 | 760 |
| I-12 (.03) | 0.80/.08 | 35 | 810 |
| II-1 (.06) + I-12 (.03) | 0.95/.07 | 86 | — |
| II-2 (.03) | 0.18/.04 | 33 | 775 |
| I-12 (.03) | 0.80/.08 | 35 | 810 |
| II-2 (.03) + I-12 (.03) | 0.88/.06 | 64 | — |
| II-2 (.03) | 0.21/.04 | 31 | 775 |
| I-13 (.03) | 0.86/.06 | ~35 | 830 |
| II-2 (.03) + I-12 (.03) | 1.01/.07 | ~90 | — |
| II-2 (.03) | 0.23/.04 | 31 | 775 |
| I-11 (.03) | 0.87/.06 | 32 | 810 |
| II-2 (.03) + I-11 (.03) | 0.97/.08 | 58 | — |
| II-3 (.03) | 0.56/.05 | 30 | 775 |

TABLE IV-continued

| Dyes (mmoles/mole Ag) | $10^{-4}$ sec. WR89B Speed/Fog | Spectral Width (nm) | λ-max (nm) |
|---|---|---|---|
| I-11 (.03) | 0.87/.06 | 32 | 810 |
| II-3 (.03) + I-11 (.03) | 1.02/.05 | 59 | — |
| Comparison Combinations | | | |
| II-2 (.015) | <0.23/.04 | 30 | 775 |
| C-1 (.03) | 0.61/.04 | 41 | 820 |
| II-2 (.015) + C-1 (.03) | 0.60/.04 | 66 | — |
| *II-2 (.03) | 0.18/.04 | 33 | 775 |
| *C-1 (.03) | 0.47/.04 | 38 | 820 |
| *II-2 (.03) + C-1 (.03) | 0.39/.04 | 70 | — |

*no diisooctyl hydroquinone added

C-1

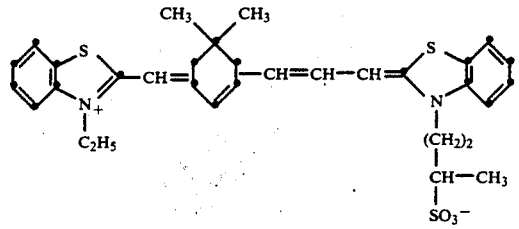

The data in Table IV show that the dyes of formula (I), when combined with a shorter wavelength dye according to the invention, give a broad spectral sensitivity distribution and a speed to a broadband infrared exposure which is higher than the speed of either dye alone. In contrast, the comparison dye, when combined with a shorter wavelength dye, gives a broad spectral sensitivity distribution but the speed to broadband infrared exposure is at best equivalent to or lower than either dye alone.

EXAMPLE 2

Dye combinations according to the invention and a comparison single dye with broad spectral sensitivity (dye C-2) were coated in the format described in Example 1 and tested for safelight sensitivity and fog growth on incubation. Fog growth for coatings kept at 49° C. and 50% relative humidity for 1 week was determined by comparing the fog of the kept coatings to fog of identical coatings stored at −18° C. for the same period. Processing was as described in Example 1. Safelight sensitivity was determined by exposing the coatings for 2 minutes to a green safelight constructed from two 15 watt green fluorescent tubes and additional filtration to allow only light of wavelengths between 500 and 600 nm to be available from the safelight. Exposures were made through a step wedge ranging in density from 0 to 3 density units in 0.15 density steps. After processing, safelight speeds were determined at 0.3 density units above fog. The results from the incubation and safelight tests are summarized in Table V.

C-2

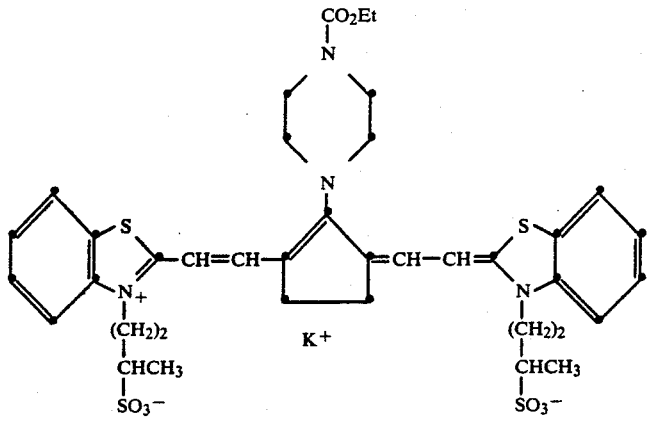

TABLE V

| Dyes (m moles/ mole Ag) | $10^{-4}$ sec WR89B Speed/Fog | Spectral Width (nm) | Fog Increase 1 week at 49° C./50% RH | Speed for Safelight Exposure |
|---|---|---|---|---|
| C-2 (.03) | 0.75/.04 | 56 | +0.19 | 1.61 |
| II-1 (.03) + I-12 (.03) | 0.90/.07 | ~70 | +0.02 | 0.75 |
| II-2 (.03) + I-12 (.03) | 0.88/.06 | 64 | 0 | 0.72 |
| II-2 (.03) + I-11 (.03) | 0.93/.06 | 58 | +0.03 | 1.18 |
| II-3 (.03) + I-11 (.03) | 1.00/.06 | 59 | +0.01 | 1.50 |

The data presented in Table V show that dye combinations containing the dyes of formula (I) as the long wavelength dye also show advantages over single broad sensitivity dyes. These advantages include: lower fog growth on incubation, improved protection against safelight fog, and improved ability to manipulate the spectral sensitivity envelope to give relatively flat spectral sensitivity over the desired wavelength range.

EXAMPLE 3

A photographic element similar to that described in Example 1 was also prepared for examining dye combinations. This element contained a high-contrast sulfur plus gold sensitized 0.28 μm cubic silver halide emulsion containing 70% chloride and 30% bromide and doped with rhodium. The emulsion was doctored with 500 mg/mole Ag of the supersensitizer T-2, 50 mg/mole Ag of ascorbic acid, a substituted tetraazaindene antifoggant, and a substituted phenyl-mercaptotetrazole antifoggant. Dyes I-10 and II-2 were added to the emulsion at the levels listed in Table III. The coating laydown and overcoat used were the same as described in Example 1.

The broadband infrared speed was determined by exposing the coatings to a $10^{-3}$ sec xenon flash from a sensitometer filtered through a Kodak Wratten® filter number 89B, a 1.0 neutral density filter, and a step wedge ranging in density from 0 to 3 density units in 0.15 density stePs. After processing for 6 minutes as described in Example 1, speeds were determined at a density of 1.0 above fog. The λ-max and spectral width for these coatings was determined using the procedure described in Example 1. The results are presented in Table VI.

TABLE VI

| II-2 Level (m moles/ mole Ag) | I-10 Level (m moles/ mole Ag) | Speed | Fog | Spectral Width (nm) |
|---|---|---|---|---|
| 0 | 0.015 | 1.05 | 0.04 | 30 |
| 0 | 0.03 | 1.40 | 0.05 | 32 |
| 0.015 | 0 | 0.77 | 0.04 | 32 |
| 0.03 | 0 | 0.92 | 0.04 | 35 |
| 0.015 | 0.015 | 1.29 | 0.04 | 41 |
| 0.03 | 0.015 | 1.30 | 0.04 | 40 |
| 0.015 | 0.03 | 1.45 | 0.05 | 45 |
| 0.03 | 0.03 | 1.46 | 0.05 | 46 |

The data presented in Table VI show that the combination of a given concentration of the longer wavelength dye I-10 with a given concentration of the shorter wavelength dye II-2 gives a spectral sensitization with broader spectral width and higher broadband speed than the same concentration of either dye alone.

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion layer spectrally sensitized with (a) a first sensitizing dye according to the formula:

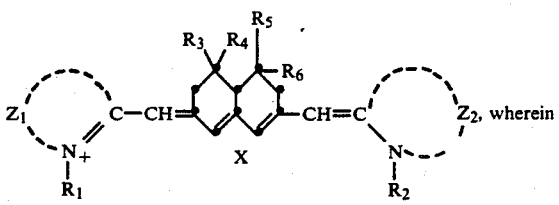

$Z_1$ and $Z_2$ each independently represents the atoms necessary to complete a substituted or unsubstituted 5- or 6-membered heterocyclic nucleus, $R_1$ and $R_2$ each independently represents substituted or unsubstituted alkyl or substituted or unsubstituted aryl, $R_3$, $R_4$, $R_5$, and $R_6$ each independently represents hydrogen, substituted or unsubstituted alkyl, substituted or unsubstituted aryl, and X represents a counterion as needed to balance the charge of the molecule, and (b) a second sensitizing dye having a maximum sensitivity at a wavelength of about 5 to 100 nm less than the wavelength of maximum sensitivity of the first sensitizing dye.

2. A photographic element according to claim 1 wherein the second sensitizing dye has its maximum sensitivity at a wavelength of about 5 to 60 nm less than the wavelength of maximum sensitivity of the first sensitizing dye.

3. A photographic element according to claims 1 or 2 wherein said second sensitizing dye has the formula:

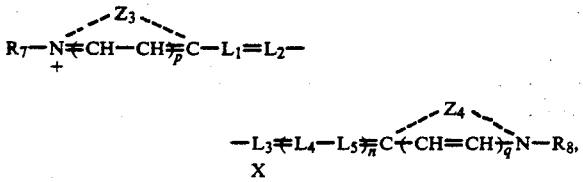

wherein $L_1$, $L_2$, $L_3$, $L_4$, and $L_5$ each independently represents a substituted or unsubstituted methine group, $Z_3$ and $Z_4$ each independently represents the atoms necessary to complete a substituted or unsubstituted 5-or 6-membered heterocyclic nucleus, $R_7$ and $R_8$ each independently represents substituted or unsubstituted alkyl or substituted or unsubstituted aryl, X represents a counterion as needed to balance the charge of the molecule, p and q each independently represents 0 or 1, and n represents 1 or 2, or, if at least one of p and q is 1, may also represent 0.

4. A photographic element according to claim 3 wherein said second sensitizing dye has the formula:

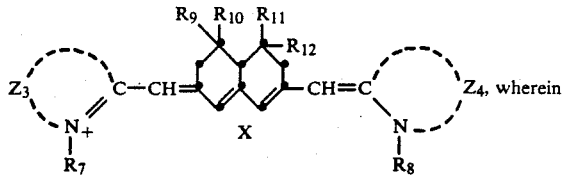

$R_9$, $R_{10}$, $R_{11}$, and $R_{12}$ each independently represents hydrogen, substituted or unsubstituted alkyl, substituted or unsubstituted aryl.

5. A photographic element according to claim 3 wherein the first sensitizing dye has its maximum sensitivity at between about 760 nm and 840 nm.

6. A photographic element according to claim 3 wherein $Z_1$ and $Z_2$ each independently represents the atoms necessary to complete a substituted or unsubstituted: thiazole nucleus, selenazole nucleus, quinoline nucleus, tellurazole nucleus, or pyridine nucleus.

7. A photographic element according to claim 6 wherein $Z_1$ and $Z_2$ represent substituted or unsubstituted thiazole nuclei.

8. A photographic element according to claim 3 wherein the first sensitizing dye has its maximum sensitivity at between about 700 nm and 760 nm.

9. A photographic element according to claim 3 wherein at least one of $Z_1$ and $Z_2$ represents the atoms necessary to complete a substituted or unsubstituted.. oxazole nucleus or thiazoline nucleus.

10. A photographic element according to claim 3 wherein said first dye has a maximum sensitivity at a wavelength of about 780 nm to 820 nm and said second sensitizing dye has a maximum sensitivity at a wavelength of about 750 nm to 780 nm.

* * * * *